US008418639B2

(12) United States Patent
Hooper et al.

(10) Patent No.: US 8,418,639 B2
(45) Date of Patent: Apr. 16, 2013

(54) MOORING SYSTEM FOR A VESSEL

(75) Inventors: Alan Hooper, Singapore (SG); Balakrishna Menon, Singapore (SG); Camelia Dragu, Singapore (SG)

(73) Assignee: APL Technology AS, Kolbjornsvik (NO)

( * ) Notice: Subject to any disclaimer, the term of this patent is extended or adjusted under 35 U.S.C. 154(b) by 307 days.

(21) Appl. No.: 12/733,442

(22) PCT Filed: Sep. 7, 2007

(86) PCT No.: PCT/SG2007/000303

§ 371 (c)(1), (2), (4) Date: Mar. 2, 2010

(87) PCT Pub. No.: WO2009/031971

PCT Pub. Date: Mar. 12, 2009

(65) Prior Publication Data

US 2011/0162571 A1 Jul. 7, 2011

(51) Int. Cl.
*B63B 21/00* (2006.01)

(52) U.S. Cl.
USPC ..... 114/230.12

(58) Field of Classification Search ..... 441/3–5; 114/293, 230.12
See application file for complete search history.

(56) References Cited

U.S. PATENT DOCUMENTS

| | | | |
|---|---|---|---|
| 4,604,961 | A | 8/1986 | Ortloff et al. |
| 4,606,727 | A | 8/1986 | Koenig et al. |
| 4,637,335 | A | 1/1987 | Pollack |
| 4,698,038 | A | 10/1987 | Key et al. |
| 4,701,143 | A | 10/1987 | Key et al. |
| 4,841,895 | A | 6/1989 | Brewerton |
| 4,892,495 | A | 1/1990 | Svensen |
| 5,002,433 | A | 3/1991 | Paasche et al. |
| 5,113,778 | A | 5/1992 | Paasche et al. |
| 5,237,948 | A | 8/1993 | Hvide |
| 5,240,446 | A | 8/1993 | Boatman et al. |
| 5,266,061 | A | 11/1993 | Poldervaart et al. |
| 5,292,271 | A | 3/1994 | Boatman et al. |
| 5,306,186 | A | 4/1994 | Boatman |
| 5,316,509 | A | 5/1994 | Boatman et al. |
| 5,339,760 | A | 8/1994 | Korsgaard |
| 5,356,321 | A | 10/1994 | Boatman et al. |

(Continued)

FOREIGN PATENT DOCUMENTS

| | | |
|---|---|---|
| AU | B-43597/93 | 12/1993 |
| GB | 2 267 687 | 12/1993 |

(Continued)

*Primary Examiner* — Edwin Swinehart
(74) *Attorney, Agent, or Firm* — Mattingly & Malur, P.C.

(57) ABSTRACT

A mooring system for a vessel and a method of mooring a vessel are provided. The mooring system comprises a turret structure; a swivel unit mounted on the turret structure; a bearing assembly for rotatably mounting the turret structure at deck level of the vessel such that the turret structure extends into a moonpool of the vessel and such that the swivel unit is disposed above deck level; a plurality of conduits for fluid communication disposed in the turret structure; a buoy structure retrievable into the moonpool of the vessel and connectable to the turret structure; a locking assembly for mechanically locking the buoy structure to the turret structure; and wherein the turret structure is rotatable as one to align the conduits to corresponding riser valve structures on the buoy structure prior to mechanically locking the buoy structure to the turret structure.

13 Claims, 9 Drawing Sheets

U.S. PATENT DOCUMENTS

| | | | |
|---|---|---|---|
| 5,363,789 | A | 11/1994 | Laurie et al. |
| 5,372,531 | A | 12/1994 | Boatman et al. |
| 5,380,229 | A | 1/1995 | Korsgaard |
| 5,540,607 | A | 7/1996 | Breivik et al. |
| 5,647,295 | A | 7/1997 | Korsgaard |
| 5,651,708 | A | 7/1997 | B.o slashed.rseth |
| 5,676,083 | A | 10/1997 | Korsgaard |
| 5,697,732 | A | 12/1997 | Sigmundstad |
| 5,749,758 | A | 5/1998 | Breivik et al. |
| 5,794,700 | A | 8/1998 | Pollack |
| 5,820,429 | A | 10/1998 | Smedal et al. |
| 5,823,131 | A | 10/1998 | Boatman et al. |
| 5,823,837 | A | 10/1998 | Boatman et al. |
| 5,860,840 | A | 1/1999 | Boatman et al. |
| 5,893,333 | A | 4/1999 | Smedal |
| 5,895,077 | A | 4/1999 | Sigmundstad |
| 5,941,746 | A | 8/1999 | Isnard et al. |
| 5,983,931 | A | 11/1999 | Ingebrigtsen et al. |
| 6,021,848 | A | 2/2000 | Breivik et al. |
| 6,050,747 | A | 4/2000 | Midttveit |
| 6,053,787 | A | 4/2000 | Erstad et al. |
| 6,155,193 | A | 12/2000 | Syvertsen et al. |
| 6,199,500 | B1 | 3/2001 | B.o slashed.rseth et al. |
| 6,269,762 | B1 | 8/2001 | Commandeur |
| 6,302,048 | B1 | 10/2001 | Smedal |
| 6,390,478 | B1 | 5/2002 | Sigmundstad |
| 6,412,433 | B1 | 7/2002 | Breivik et al. |
| 6,474,252 | B1 * | 11/2002 | Delago ..... 114/230.12 |
| 6,502,524 | B1 | 1/2003 | Hooper |
| 6,543,376 | B1 | 4/2003 | Egge et al. |
| 6,588,357 | B1 | 7/2003 | Hobdy |
| 6,595,154 | B2 | 7/2003 | Boatman |
| 6,631,745 | B2 | 10/2003 | Fontenot et al. |
| 6,698,372 | B2 | 3/2004 | Hobdy et al. |
| 6,736,082 | B2 | 5/2004 | Breivik et al. |
| 6,827,493 | B2 | 12/2004 | Hooper |
| 7,063,032 | B2 | 6/2006 | Lindblade et al. |
| 7,172,479 | B2 | 2/2007 | Poldervaart et al. |
| 2004/0029464 | A1 | 2/2004 | Pollack et al. |
| 2004/0055522 | A1 | 3/2004 | Boatman et al. |
| 2004/0106339 | A1 | 6/2004 | Breivik |
| 2004/0261682 | A1 | 12/2004 | Lindblade |
| 2007/0155259 | A1 | 7/2007 | Van Tol et al. |

FOREIGN PATENT DOCUMENTS

| | | |
|---|---|---|
| GB | 2 285 028 | 6/1995 |
| WO | WO 93/06001 | 4/1993 |
| WO | 93/24731 | 12/1993 |
| WO | 93/24732 | 12/1993 |
| WO | 93/24733 | 12/1993 |

* cited by examiner

MOORING SYSTEM FOR A VESSEL

CROSS-REFERENCE TO RELATED APPLICATIONS

This application is the U.S. National Phase, under 35 U.S.C. 371, of PCT/SG2007/000303, filed Sep. 7, 2007 and published as WO 2009/031971 A1 on Mar. 12, 2009, the disclosures of which are expressly incorporated herein by reference.

FIELD OF INVENTION

The invention relates broadly to a mooring system for a vessel and to a method of mooring a vessel.

BACKGROUND

In recent years, the offshore oil and gas drilling industry has began using floating storage and production vessels instead of fixed platforms. Under this arrangement, a ship, such as a retired tanker, is typically moored to a mooring buoy, spider, or similar device connected to the seabed at the location of an undersea well. A riser is connected from the undersea well to the ship for delivering the oil or gas product. Thus, the ship can receive the oil or gas product from the undersea well and acts as a temporary storage facility for the product.

It is desirable in open or unprotected waters to moor the ship to the mooring buoy in such a manner that the ship is free to rotate or swivel about the mooring in a practice known as weathervaning. By this method, the ship is free to move in accordance with the prevailing currents and winds, while still remaining moored to the seabed. This freedom to swivel is typically accomplished by mounting a cylindrical mooring turret vertically within the ship in such a manner that the turret is able to rotate or swivel about a vertical axis relative to the ship. The turret is typically moored by one or more mooring lines know as catenaries which extend to the seabed. A mooring buoy, spider, or other connection joint or platform may be used to interface between the catenaries and the bottom of the turret. In addition, one or more oil production risers extend from a wellhead on the seabed into the turret, and the output from the risers is fed into processing equipment on the ship and then into the tanks in the ship for temporary storage.

U.S. Pat. No. 6,595,154 describes a turret rotatably supported by bearings in a moonpool of a vessel and the bottom of the turret includes a hydraulically powered structural connector for retrieving a buoy. U.S. Pat. No. 6,595,154 does not describe or teach alignment of the turret with respect to the buoy. As will be appreciated by a person skilled in the art, using the system of U.S. Pat. No. 6,595,154, it is practically difficult to retrieve/connect the buoy to the turret. Furthermore, it is practically difficult to align the fluid conduits of the turret to the risers. In addition, as the buoy is connected to the turret at the bottom of the vessel, retrieving the buoy may cause damage to the hull of the vessel as the buoy contacts the hull of the vessel during retrieval.

U.S. Pat. No. 6,155,193 describes retrieving a buoy and lifting the buoy using railings in a moonpool of a vessel to a top deck of the vessel. Risers from the buoy are then connected to fluid conduits at the top deck. As will be appreciated by a person skilled in the art, it is practically difficult and is a massive undertaking to implement the system of U.S. Pat. No. 6,155,193.

US 2007/0155259 describes a vessel with a moonpool that is provided by means of a casing mounted in the vessel and the casing includes a shaft extending within the hull of the vessel and an inverted cone extending above deck level and coupled to the hull below deck level. The cone supports a main bearing assembly. A separate turret structure is described to comprise a rotatable turntable, which has mounted thereon a swivel unit. During retrieval of a buoy, the buoy is first locked in a receptacle cone of the turret structure and the turntable is then rotated to align fluid conduits to risers of the buoy. After aligning and connection of the fluid conduits to the risers, independent rotation of the turntable is disabled and as a result, the vessel weathervanes with respect to the entire turret structure, ie. including the turntable. Furthermore, in another embodiment, US 2007/0155259 describes that a rough prepositioning of the turret structure relative to the buoy is necessary before locking the buoy in the receptacle cone. After locking the buoy in the receptacle cone, a final alignment is performed by rotational movement of lower parts of the fluid conduits in a plane parallel to the top of the buoy, for connecting the fluid conduits to the risers. Thus, using US 2007/0155259, it is practically complex and difficult to implement a rotatable turntable or a fluid conduit structure that enables rotational movement of lower parts of the fluid conduits in a plane parallel to the top of the buoy as a separate alignment system with respect to the turret structure. Furthermore, the cone of the casing is required to deal with tension or flexing forces transmitted from the vessel to the turret structure during e.g. difficult weather conditions. The requirement of the cone also means that the main bearing assembly is suspended above deck level. This can render maintenance and control of the main bearing assembly practically difficult. Furthermore, the suspended main bearing assembly has a diameter smaller than the diameter of the moonpool and thus, this limits the performance of the main bearing assembly e.g. in terms of axial, radial and bending loads. In addition, it is practically time consuming to perform a rough prepositioning followed by a final alignment during a retrieval operation of the buoy.

AU-B-43597/93 describes a vessel retrieving a buoy having an outer member and a central member rotably mounted in the outer member. During retrieval of the buoy, the outer member is first locked in relation to the vessel. A holding cylinder disposed inside a moonpool of the vessel is aligned to the central member of the buoy by turning the holding cylinder until a cogging of the holding cylinder mechanically mates with a cogging of the central member. A non-rotatable connection is then established between a swivel unit on the deck of the vessel and the central member of the buoy via the holding cylinder. Risers from the buoy are pulled up into the holding cylinder for connection to piping from the swivel unit. As will be appreciated by a person skilled in the art, pulling the risers from the buoy into the holding cylinder may be dangerous as the likelihood of damaging the risers is higher compared to connecting the risers in situ. Furthermore, it is practically complicated to provide a buoy with a two-body structure for mechanically mating/alignment with a cylinder/structure on a vessel.

Hence, there exists a need for a mooring system for a vessel and a method of mooring a vessel to address at least one of the above problems.

SUMMARY

In accordance with a first aspect of the present invention, there is provided a mooring system for a vessel, the system comprising a turret structure; a swivel unit mounted on the turret structure; a bearing assembly for rotatably mounting the turret structure at deck level of the vessel such that the turret structure extends into a moonpool of the vessel and such that the swivel unit is disposed above deck level; a plurality of conduits for fluid communication disposed in the turret structure; a buoy structure retrievable into the moonpool of the vessel and connectable to the turret structure; a locking assembly for mechanically locking the buoy structure to the turret structure; and wherein the turret structure is rotatable as one to align the conduits to corresponding riser valve structures on the buoy structure prior to mechanically locking the buoy structure to the turret structure.

The bearing assembly may be disposed at a circumference of the moonpool.

The turret structure may be rotatable as one to align the conduits to the corresponding riser valve structures without separate rotational movement of respective lower parts of the conduits.

The bearing assembly may comprise a plurality of bearing systems, each bearing system comprising at least two bearing elements for balancing a roller shaft extending between the bearing elements; a roller member rotatable about the roller shaft such that the roller member is maintained in a substantially transverse position with respect to the roller shaft based on the bearing elements balancing the roller shaft.

The bearing systems may be disposed under a flange portion of the turret structure for supporting the turret structure.

In a locked position, a top surface of the buoy structure may be disposed substantially at a middle level of the moonpool.

The turret structure may further comprise a recovery winch unit and a guide arm for retrieving the buoy structure, the guide arm pivotably positioned on a wall of the moonpool in a manner such that a recovery rope is centralized inside the moonpool during retrieval of the buoy structure.

The swivel unit may provide fluid connections between the plurality of conduits and one or more storage tanks on the vessel.

In accordance with a second aspect of the present invention, there is provided a method of mooring a vessel, the method comprising providing a turret structure; mounting a swivel unit on the turret structure; rotatably mounting the turret structure at deck level of the vessel using a bearing assembly such that the turret structure extends into a moonpool of the vessel and such that the swivel unit is disposed above deck level; disposing a plurality of conduits for fluid communication in the turret structure; retrieving a buoy structure into the moonpool of the vessel; and rotating the turret structure as one to align the conduits to corresponding riser valve structures on the buoy structure prior to mechanically locking the buoy structure to the turret structure.

The method may further comprise providing the bearing assembly at a circumference of the moonpool.

The method may further comprise rotating the turret structure as one to align the conduits to the corresponding riser valve structures without separately rotating respective lower parts of the conduits.

The bearing assembly may comprise a plurality of bearing systems, for each bearing system, the method may comprise providing at least two bearing elements; balancing a roller shaft extending between the bearing elements; providing a roller member rotatable about the roller shaft; and maintaining the roller member in a substantially transverse position with respect to the roller shaft based on the balancing of the roller shaft.

The method may further comprise disposing the bearing systems under a flange portion of the turret structure for supporting the turret structure.

In a locked position, a top surface of the buoy structure may be disposed substantially at a middle level of the moonpool.

The method may further comprise providing a recovery winch unit and a guide arm for retrieving the buoy structure; pivotably positioning the guide arm on a wall of the moonpool; and using the guide arm such that a recovery rope is centralized inside the moonpool during retrieval of the buoy structure.

The method may further comprise providing fluid connections between the plurality of conduits and one or more storage tanks on the vessel using the swivel unit.

BRIEF DESCRIPTION OF THE DRAWINGS

Embodiments of the invention will be better understood and readily apparent to one of ordinary skill in the art from the following written description, by way of example only, and in conjunction with the drawings, in which:

FIG. 3(*b*) is a schematic plan view diagram of the axial bearing system.

FIG. 3(*c*) is a schematic side view diagram of a radial bearing system of the turret mooring system.

FIG. 3(*d*) is a schematic plan view diagram of the radial bearing system.

FIG. 4(*b*) is a schematic side view diagram illustrating a side portion of the shaft in contact with the radial bearing system.

FIG. 4(*c*) is a schematic top view diagram illustrating a bearing assembly arranged circumferentially around a moonpool at deck level to support the shaft.

DETAILED DESCRIPTION

Figure 1:
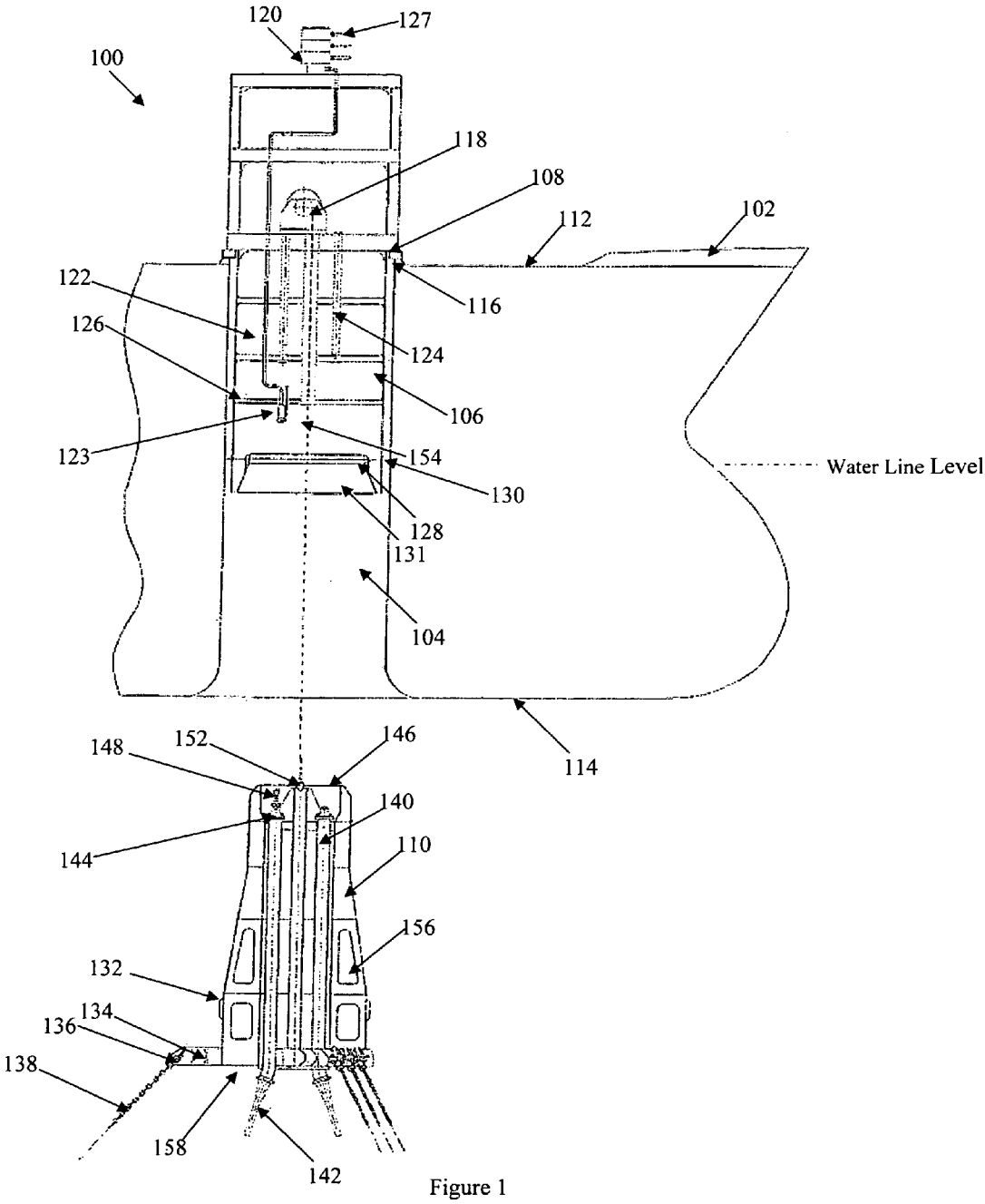
FIG. 1 is a schematic diagram illustrating a turret mooring system in an example embodiment.

FIG. 1 is a schematic diagram illustrating a turret mooring system 100 in an example embodiment. The turret mooring system 100 is provided for use on a vessel 102. The vessel 102 comprises a caisson or moonpool 104 for accommodating the turret mooring system 100. As will be appreciated by a person skilled in the art, FIG. 1 shows a buoy 110 in a disconnected state in relation to the vessel 102.

The turret mooring system 100 comprises a turret structure or shaft 106 that is supported by and is rotatably engaging an upper bearing assembly 108. The moonpool 104 is preferably circular and provides a housing within the vessel 102 for the shaft 106 and the buoy 110. Thus, the moonpool 104 extends from the deck level 112 of the vessel 102 to the keel level or bottom 114 of the vessel 102. The upper bearing assembly 108 is mounted on the deck level 112 of the vessel 102 and is of a self-aligning type. An upper flange 116 of the moonpool 104 is provided to support the upper bearing assembly 108.

The shaft 106 comprises a recovery winch 118, a fluid swivel unit 120, fluid conduits e.g. 122, riser quick connectors e.g. 123 connected to the fluid conduits e.g. 122, riser pull-in guide tubes e.g. 124 and an access platform 126. The riser pull-in guide tubes e.g. 124 are only used for installation or deinstallation of buoy risers and not for normal connection and disconnection of buoy risers for extraction of fluid. In other words, the risers may be lifted to the top of the buoy 110 for maintenance. In the example embodiment, extraction of fluid is carried out using the fluid conduits e.g. 122 below deck level and substantially at a middle level of the shaft 106. The fluid swivel unit 120 comprises pipes e.g. 127 connected to the fluid conduits e.g. 122 for extracting fluids from the buoy 110. The pipes e.g. 127 are connected to a storage system (not shown) on the vessel 102. The riser quick connectors e.g. 123 are for connecting to corresponding riser valve structures on the buoy 110. The access platform 126 allows access to the components of the shaft 106 such as the riser quick connectors e.g. 123, for maintenance purposes. At a lower end of the shaft 106, the shaft 106 further comprises an guide and lock mechanism 128 and a guide bearing 130. The guide bearing 130 allows the shaft 106 to manoeuvre within the moonpool 104 during retrieval of the buoy 110. The guide bearing 130 also prevents movement of the shaft 106 in the moonpool 104 when the buoy 110 is disconnected from the shaft 106. In the example embodiment, the shaft 106 comprises a receptacle space 131 shaped such that the receptacle space 131 can fittingly receive the buoy 110.

Referring to the buoy 110, the buoy 110 comprises a bearing 132 for absorbing horizontal loads on the buoy 110 and an anchoring structure 134. The anchoring structure 134 comprises chain stoppers e.g. 136 for securing mooring lines e.g. 138. The buoy is moored to the seabed (not shown) by the mooring lines e.g. 138. The buoy 110 further comprises tubes e.g. 140 disposed in the centre of the buoy 110. The tubes e.g. 140 comprise fluid risers e.g. 142 that are secured to the top of the tubes e.g. 140 using riser end fittings e.g. 144. The riser end fittings e.g. 144 are not intended for pulling up of the fluid risers e.g. 142 for extraction of fluid. That is, the riser end fittings e.g. 144 are not displaced vertically during extraction of fluid from the fluid risers e.g. 142 during normal operation. The riser end fittings e.g. 144 may be disengaged from the buoy 110 only outside normal operation processes e.g. for pulling up the fluid risers e.g. 142 for periodic or necessary maintenance purposes. It is noted again that extraction of fluid is carried out using the fluid conduits e.g. 122 below deck level and substantially at a middle level of the shaft 106. The fluid risers e.g. 142 are for transmitting fluid from e.g. a well (not shown) at the seabed. The top of the tubes e.g. 140 is near to the top 146 of the buoy 110. The buoy 110 further comprises riser valves e.g. 148 fitted to the risers e.g. 142 for closing the risers and preventing fluid loss when the buoy 110 is not connected to the vessel 102. The riser valves e.g. 148 are used for turning on/off fluid communication between the respective risers e.g. 142 and the fluid conduits e.g. 122 in the shaft 106, when the buoy 110 is connected to the vessel 102. A connector 152 is provided in the centre of the buoy 110 for connecting a recovery rope 154. The recovery rope 154 is used for retrieval purposes when retrieving the buoy 110 into the moonpool 104. Furthermore, the buoy 110 is provided with a plurality of water tight compartments e.g. 156 such that flooding of one compartment e.g. 156 has minimal effect on the buoyancy of the buoy 110.

Figure 2:
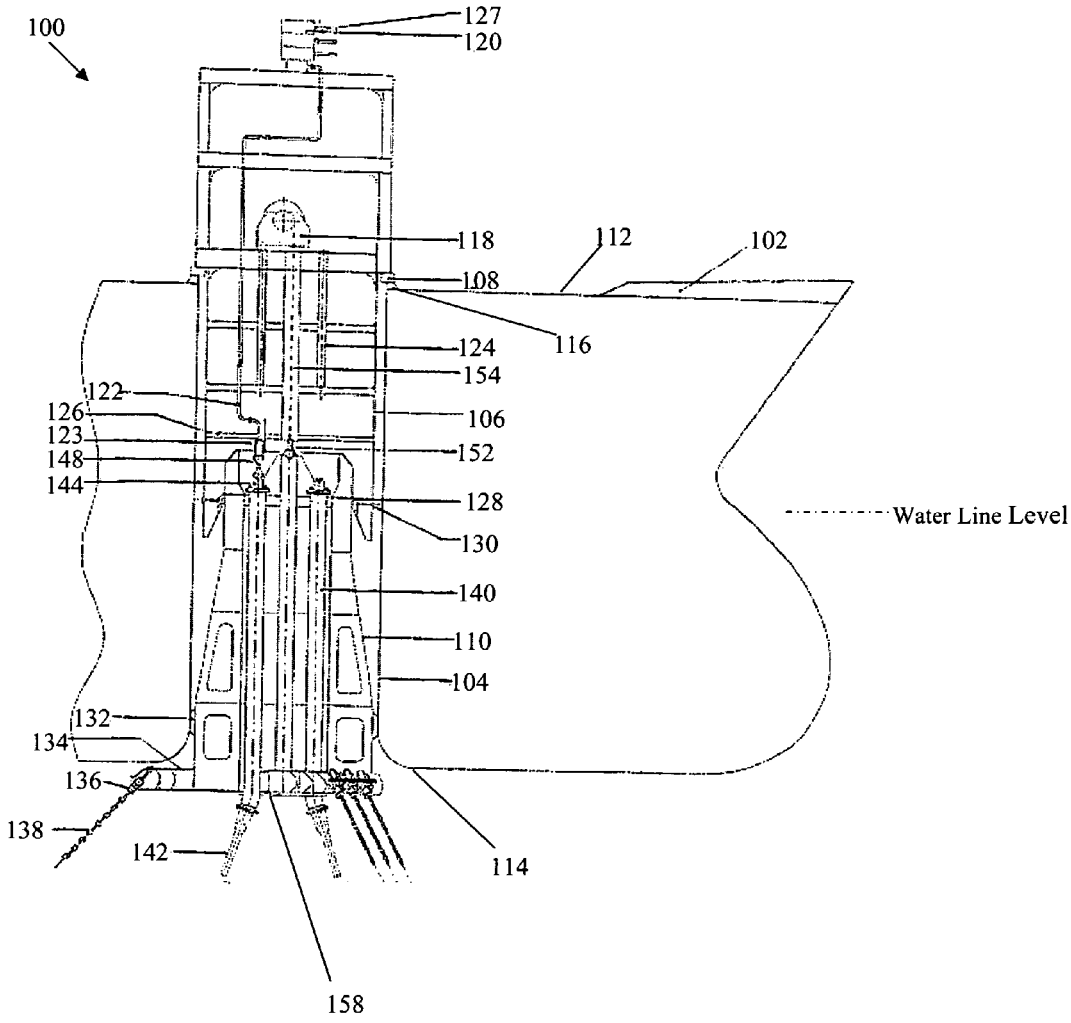
FIG. 2 is a schematic diagram illustrating the turret mooring system connected to a buoy after a retrieval/connection operation.

FIG. 2 is a schematic diagram illustrating the turret mooring system 100 connected to the buoy 110 after a retrieval/connection operation. During the retrieval/connection operation, the recovery rope 154 of the buoy 110 is retrieved and wound onto the recovery winch 118. Using the recovery rope 154, the recovery winch 118 retrieves the buoy 110 into the moonpool 104. In the example embodiment, retrieving the recovery rope 154 may be carried out by an automated system (not shown) or by divers. During retrieval of the buoy 110 into the moonpool 104, cameras are used to e.g. monitor the buoy 110 position.

For alignment, the shaft 106 is rotated inside the moonpool 104 using a motor (not shown) located on the deck level 112 and coupled to the upper bearing assembly 108 to align the riser quick connectors e.g. 123 of the turret mooring system 100 to corresponding riser valve structures (not shown) provided on the respective riser valves e.g. 148 of the buoy 110, without making actual mechanical contact with the riser valve structures. After alignment of the riser quick connectors e.g. 123 to the corresponding riser valve structures, the buoy 110 is locked in the shaft 106 using the guide and lock mechanism 128. The riser quick connectors e.g. 123 are connected to the corresponding riser valve structures of the buoy 110 and the riser valves e.g. 148 are then opened to allow fluid flow in the fluid conduits e.g. 122 to the pipes e.g. 127. Thus, in the example embodiment, advantageously, there is no requirement for further alignment/rotational movement of the riser quick connectors e.g. 123.

It is noted that the guide and lock mechanism 128 comprises two locking keys (not shown). The keys are located about 180 degrees from each other and are pivotably attached to the shaft 106. During locking, the keys are pivoted and engaged into the buoy 110 into mating recesses or keyholes. The keys transmit rotation of the buoy 110 to the shaft 106 together with the frictional forces between the buoy 110 and the shaft 106. In the example embodiment, the locking of the keys precisely aligns the buoy 110 and the shaft 106 with reference to the riser quick connectors e.g. 123 and the corresponding riser valve structures such that no further adjustment is required.

In the example embodiment, when the buoy 110 is locked in position in the shaft 106, the top 146 of the buoy 110 is disposed substantially at a middle level of the moonpool 104. Thus, extraction of fluid is carried out using the fluid conduits e.g. 122 below deck level and substantially at the middle level of the shaft 106.

In the example embodiment, the vessel 102 is allowed to rotate/weathervane according to the sea conditions around the shaft 106 and the connected buoy 110. The shaft 106 and the connected buoy 110, as one integrated structure after connection, maintains a substantially vertical position relative to the vessel 102 due to the self-aligning upper bearing assembly 108. Thus, as will be appreciated by a person skilled in the art, the shaft 106 and the connected buoy 110 are substantially unaffected by the flexing or orientation of the vessel 102 e.g. in difficult weather conditions. Furthermore, the swivel unit 120 provides another degree of rotation as the pipes e.g. 127 connected on the rotating vessel 102 can have a flexibility of movement relative to the integrated structure of the shaft 106 and the connected buoy 110.

During a disconnection operation, fluid flow in the fluid conduits e.g. 122 between the pipes e.g. 127 and the risers e.g. 142 is stopped. The riser valves e.g. 148 for the risers e.g. 142 are closed before the riser quick connectors e.g. 123 are disconnected from the corresponding riser valve structures of the buoy 110 and raised clear into shaft 106. The buoy 110 is then unlocked in the shaft 106 by disengaging the upper guide and lock mechanism 128. The recovery rope 154 is released from the recovery winch 118 to release the buoy 110 into the sea. When the buoy 110 is fully released, the recovery rope 154 is allowed to run off the recovery winch 118 and float in the sea. The buoy 110 is allowed to sink to a depth of about 60 m from the sea surface before the vessel 102 sails away.

Figure 3:
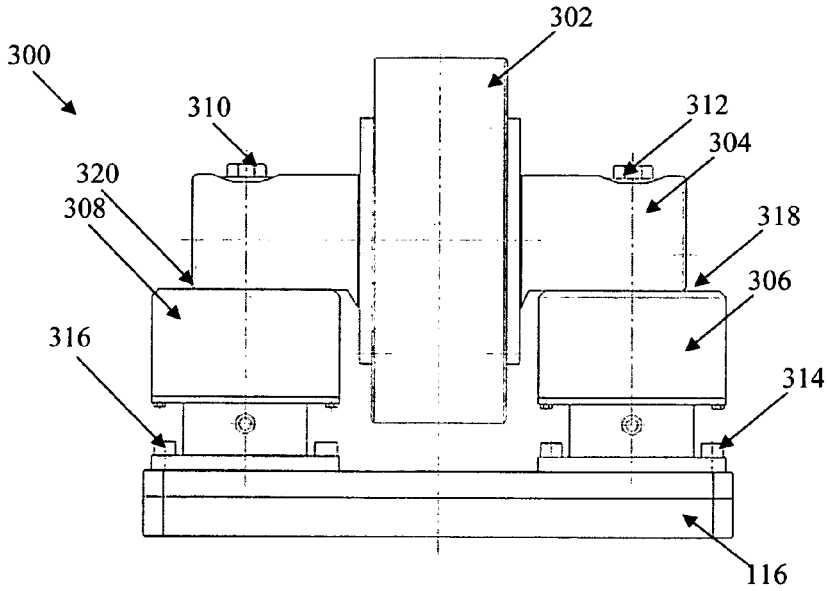
FIG. 3(*a*) is a schematic side view diagram of an axial bearing system of the turret mooring system.
Figure 3:
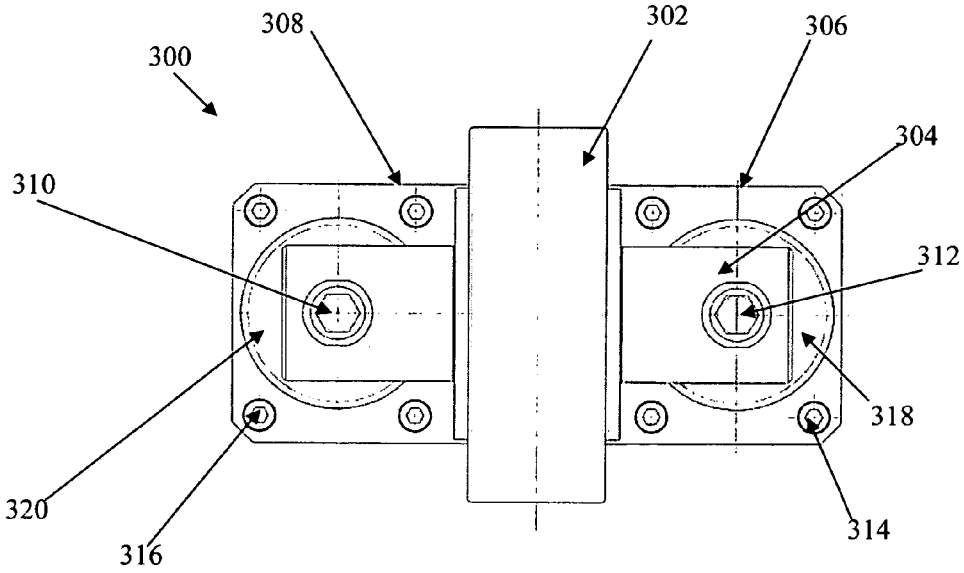
Figure 3:
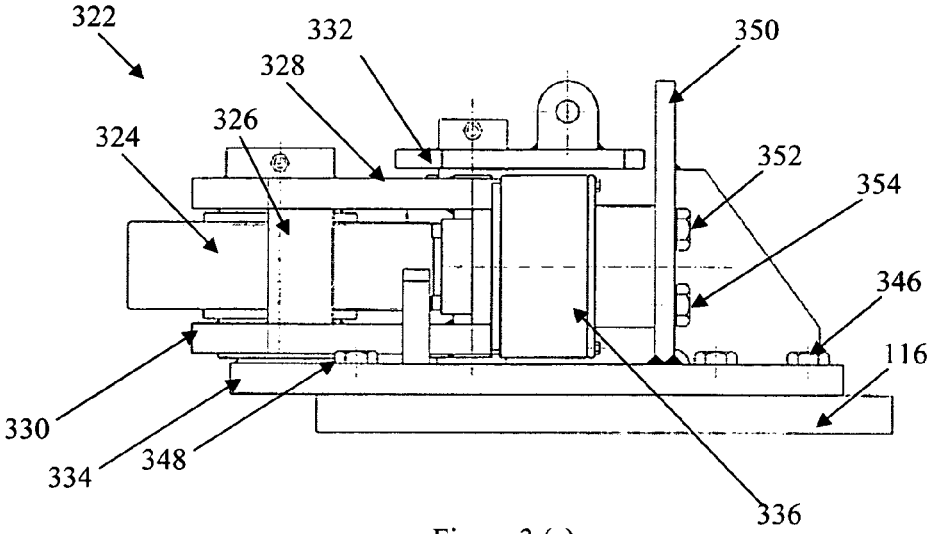
Figure 3:
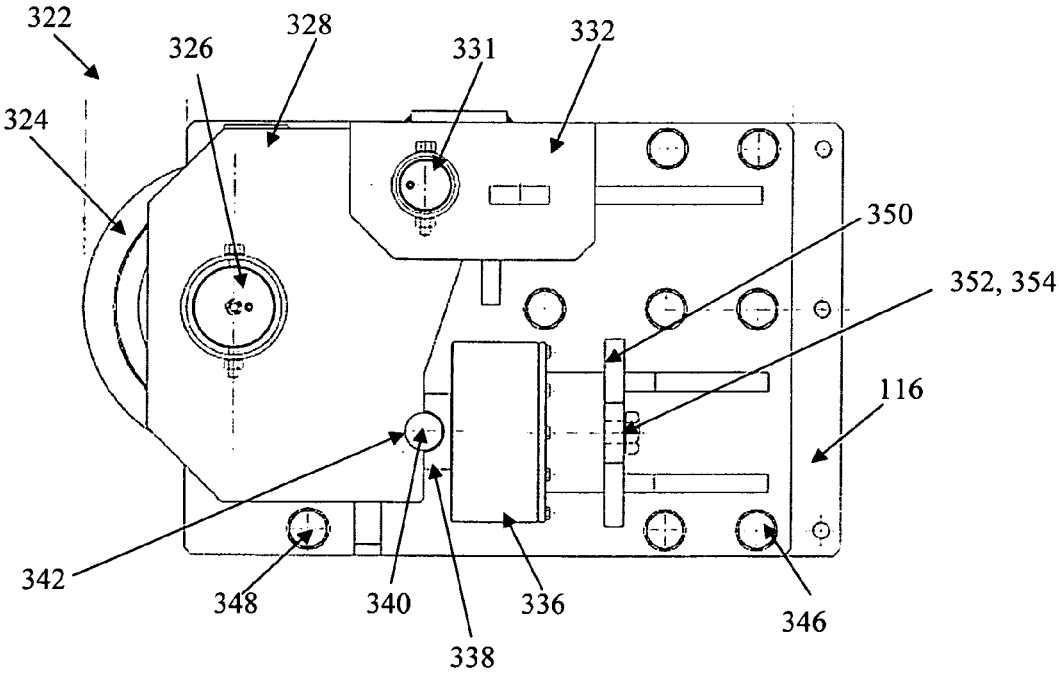

FIG. 3(*a*) is a schematic side view diagram of an axial bearing system 300 of the turret mooring system 100 (FIG. 1).

FIG. 3(*b*) is a schematic plan view diagram of the axial bearing system 300. The axial bearing system 300 is one of a plurality of substantially identical axial bearing systems forming part of the upper bearing assembly 108 (FIG. 1) of the turret mooring system 100 (FIG. 1). In other words, a plurality of axial bearing systems e.g. 300 are disposed circumferentially under the shaft 106 (FIG. 1) and circumferentially around the moonpool 104 at deck level to support the shaft 106 (FIG. 1). The axial bearing system 300 comprises a roller 302 rotatably mounted on a roller shaft 304. The shaft 304 is connected to two bearing units 306, 308 by bolts 310, 312 respectively. The bearing units 306, 308 are connected to the upper flange 116 of the vessel 102 (FIG. 1) by bolts e.g. 314, 316. In the example embodiment, as the upper flange 116 of the vessel 102 (FIG. 1) is e.g. vertically displaced due to weather or sea conditions, the bearing units 306, 308 each hydraulically, or by the use of springs, aligns respective bearing plates 318, 320 to maintain the roller shaft 304 in a substantially horizontal position relative to the upper flange 116. Since the roller shaft 304 is maintained to be substantially horizontal, the roller 302 is maintained in a substantially vertical position on the roller shaft 304.

FIG. 3(*c*) is a schematic side view diagram of a radial bearing system 322 of the turret mooring system 100 (FIG. 1). FIG. 3(*d*) is a schematic plan view diagram of the radial bearing system 322. The radial bearing system 322 is one of a plurality of substantially identical radial bearing systems forming part of the upper bearing assembly 108 (FIG. 1) of the turret mooring system 100 (FIG. 1). In other words, a plurality of radial bearing systems e.g. 322 are disposed circumferentially around the moonpool 104 at deck level and in contact with the shaft 106 (FIG. 1) to absorb/cushion radial movement of the shaft 106 (FIG. 1).

The radial bearing system 322 comprises a roller 324 rotatably mounted on a roller shaft 326. The roller shaft 326 is mounted on roller brackets 328, 330. The roller brackets 328, 330 are pivotably mounted via a pin 331 on a support bracket 332 that is in turn mounted on a base plate 334 for supporting the bearing structure. The pin 331 is supported by the support bracket 332. The radial bearing system 322 further comprises an alignment unit 336. The alignment unit 336 comprises a suspension shaft 338 and a mating shaft 340 coupled to the suspension shaft 338. The suspension shaft 338 is suspended hydraulically, or by way of springs, with respect to the alignment unit 336. The mating shaft 340 is biased into corresponding recesses e.g. 342 of the roller brackets 328, 330 by the suspension shaft 338. As illustrated in FIG. 3(*b*), the pin 331 provides support to the roller brackets 328, 330 and to the roller 324 via the roller shaft 326. The pin 331 allows the roller brackets 328, 330 and the roller assembly of the roller 324 and the roller shaft 326 to contact the suspension shaft 338 via the mating shaft 340. In the example embodiment, the radial bearing system 322 absorbs radial forces by hydraulically, or by the use of springs, transmitting the forces to the alignment unit 336 via the mating shaft 340 under pivoting of the roller brackets 328, 330 about the support bracket 332.

The radial bearing system 322 is connected to the upper flange 116 of the vessel 102 (FIG. 1) by bolts e.g. 346, 348. The alignment unit 336 is secured to an integral vertical member 350 of the base plate 334 using bolts e.g. 352, 354.

Figure 4A:
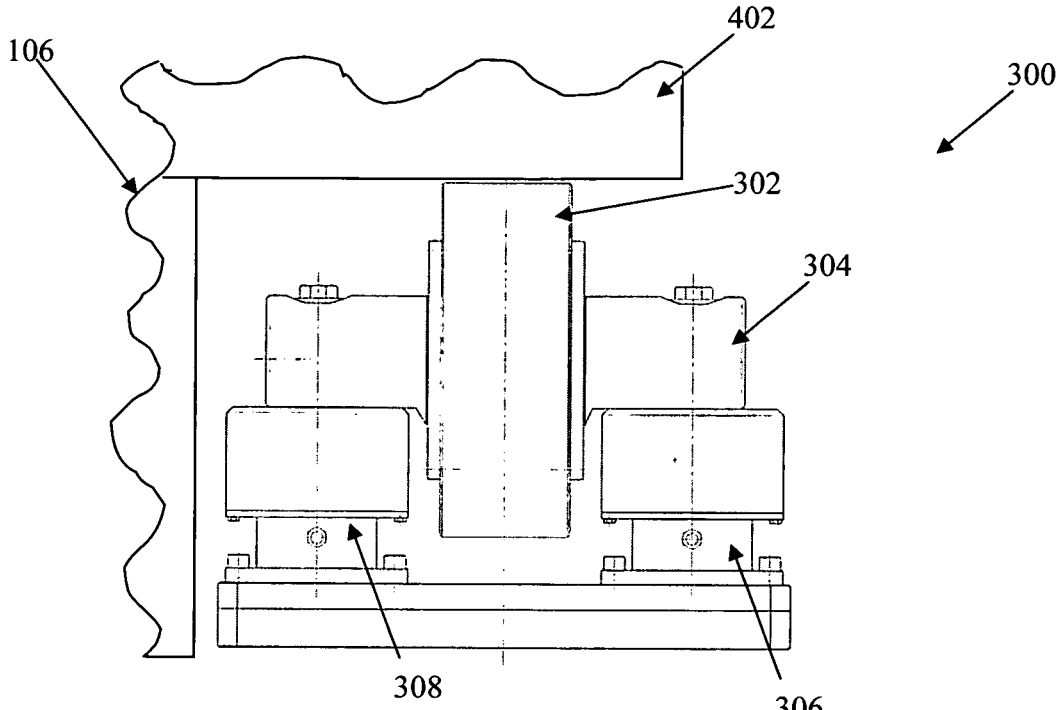
FIG. 4(*a*) is a schematic side view diagram illustrating a flange portion of an shaft supported by the axial bearing system.
Figure 4:
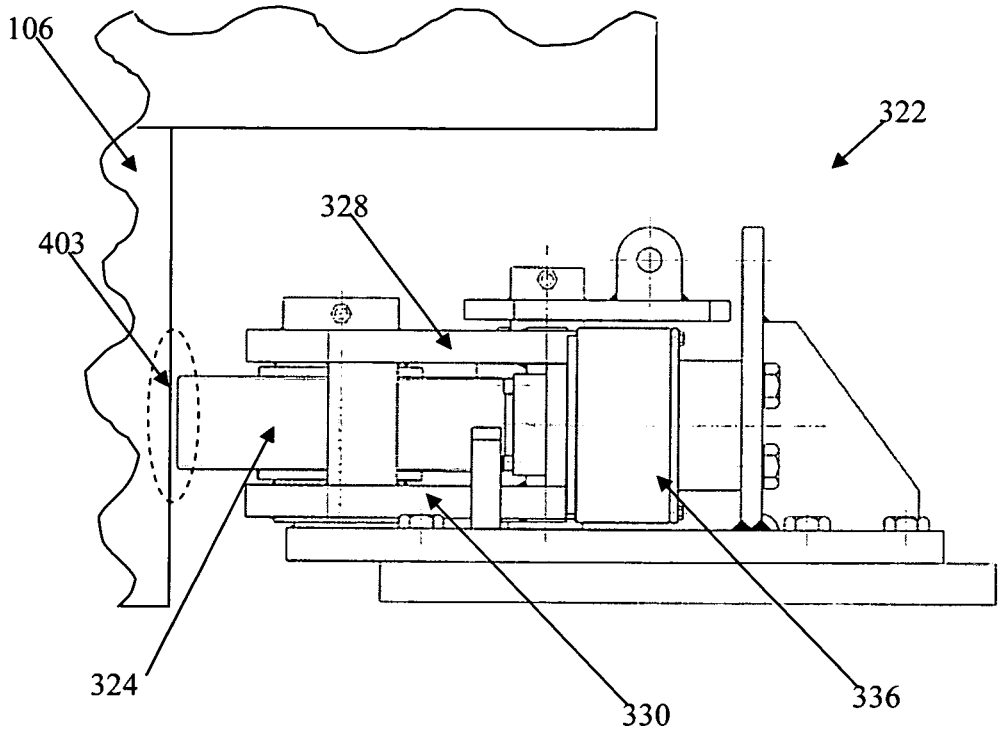
Figure 4:
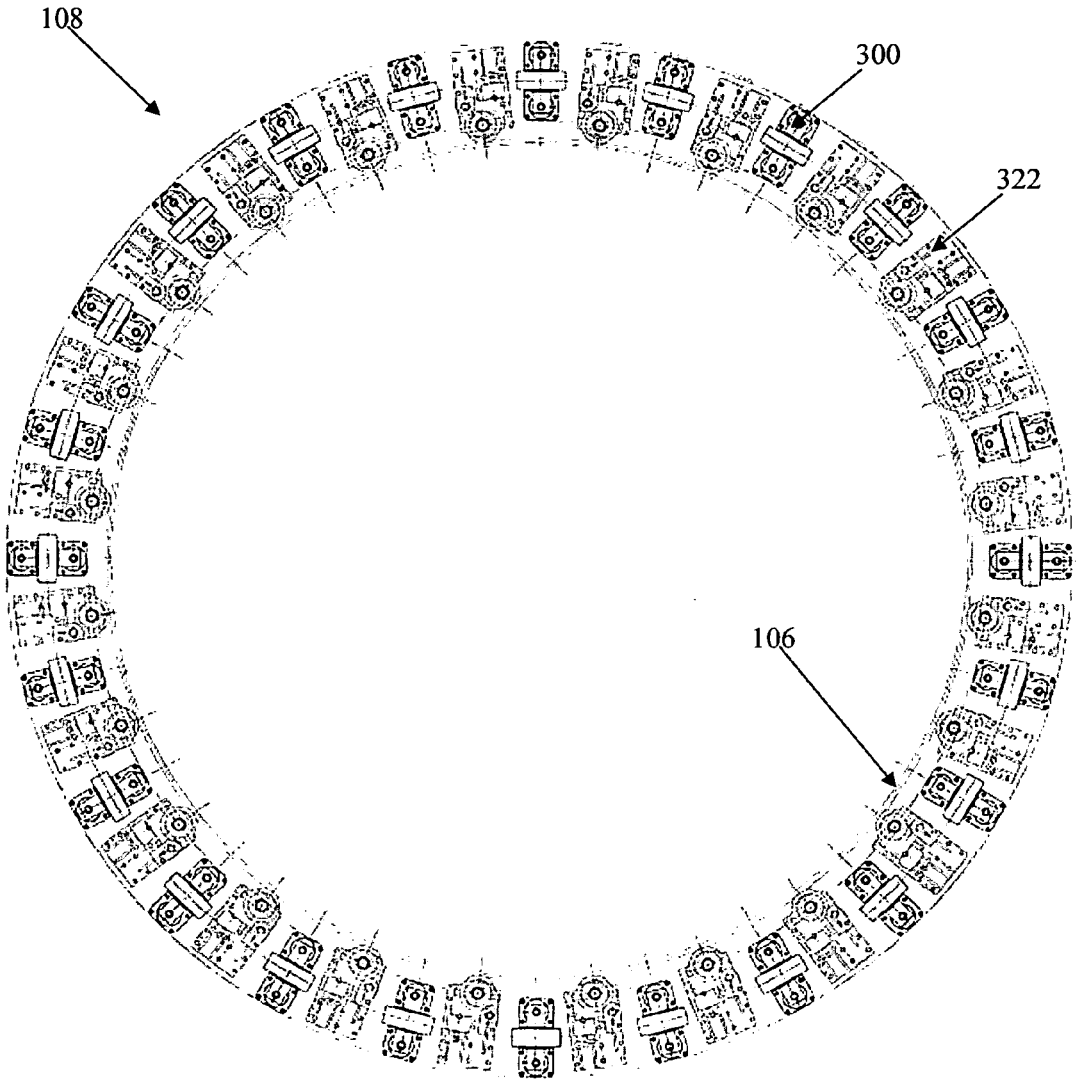

FIG. 4(*a*) is a schematic side view diagram illustrating a flange portion 402 of the shaft 106 supported by the axial bearing system 300. The flange portion 402 is supported by the roller 302 which maintains a substantially vertical position on the roller shaft 304 due to alignment capability of the bearing units 306, 308.

FIG. 4(*b*) is a schematic side view diagram illustrating a side portion 403 of the shaft 106 in contact with the radial bearing system 322. Radial forces are transmitted from the side portion 403 to the roller 324. The alignment unit 336 allows radial/horizontal displacement of the roller 324 via the roller brackets 328, 330 to hydraulically, or by the use of springs, absorb/cushion radial movement of the shaft 106.

FIG. 4(*c*) is a schematic top view diagram illustrating the upper bearing assembly 108 arranged circumferentially around the moonpool 104 at deck level to support the shaft 106. As illustrated, the upper bearing assembly 108 comprises a plurality of axial bearing systems e.g. 300 and radial bearing systems e.g. 322. Therefore, in the example embodiment, the self-aligning upper bearing assembly 108 (FIG. 1) comprising the plurality of axial bearing systems e.g. 300 and radial bearing systems e.g. 322 can enable the shaft 106, and the buoy 110 when connected (not shown), to maintain a substantially vertical position regardless of the flexing or orientation of the vessel 102 (FIG. 1) e.g. in difficult weather conditions.

Figure 5:
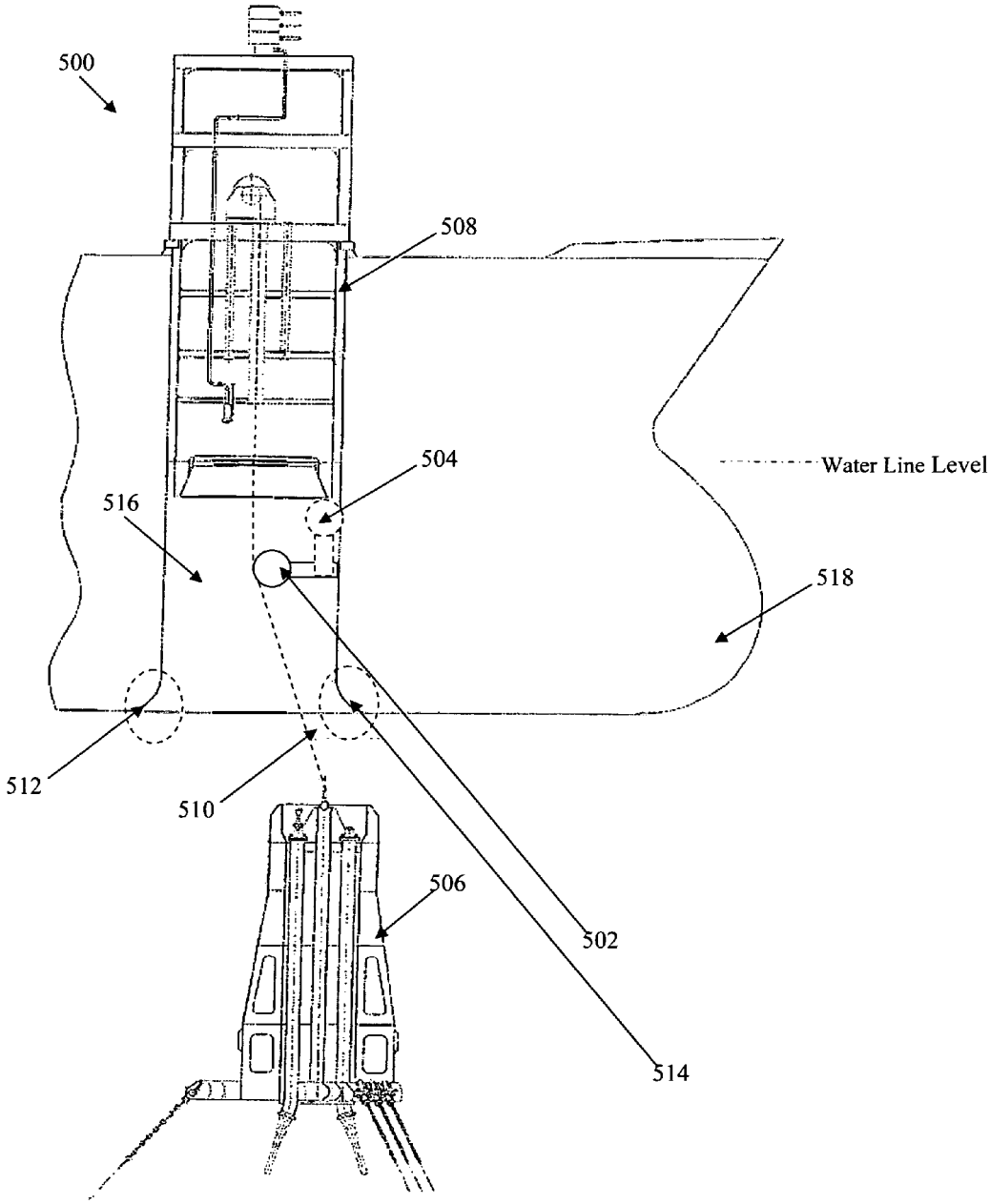
FIG. 5 is a schematic diagram illustrating a turret mooring system in another example embodiment.

FIG. 5 is a schematic diagram illustrating a turret mooring system 500 in another example embodiment. The turret mooring system 500 operates substantially identical to the turret mooring system 100 (FIG. 1) but with the addition of a pivotable guide arm or sheave 502. When the sheave 502 is not in use, it can be pivoted to a rest position (see dotted profile 504 of the sheave) such that the sheave 502 does not affect e.g. locking of the buoy 506 in the shaft 508. In this example embodiment, the sheave 502 is pivoted on the moonpool 516 for use such that the recovery rope 510 of the buoy 506 is centralised inside the shaft 508 during retrieval of the buoy 506. Thus, advantageously, contact between the recovery rope 510 and the bottom edges 512, 514 of the moonpool 516 can be avoided. In addition, the buoy 506 can advantageously be retrieved into the moonpool 516 and into contact with the shaft 508 with minimal or no contact between the buoy 506 and other parts of the vessel 518 e.g. the bottom edges 512, 514.

One advantage that may be provided by this example embodiment is that damage to the recovery rope 510 and the bottom edges 512, 514 due to frictional contact is prevented. Thus, the operational life of the recovery rope 510 can be lengthened. Another advantage that may be provided by this example embodiment is that by retrieving the buoy 506 into contact with the shaft 508 with minimal contact between the buoy 506 and other parts of the vessel 518 e.g. the bottom edges 512, 514, the damage to both the buoy 506 and the vessel 518 can be reduced.

Figure 6:
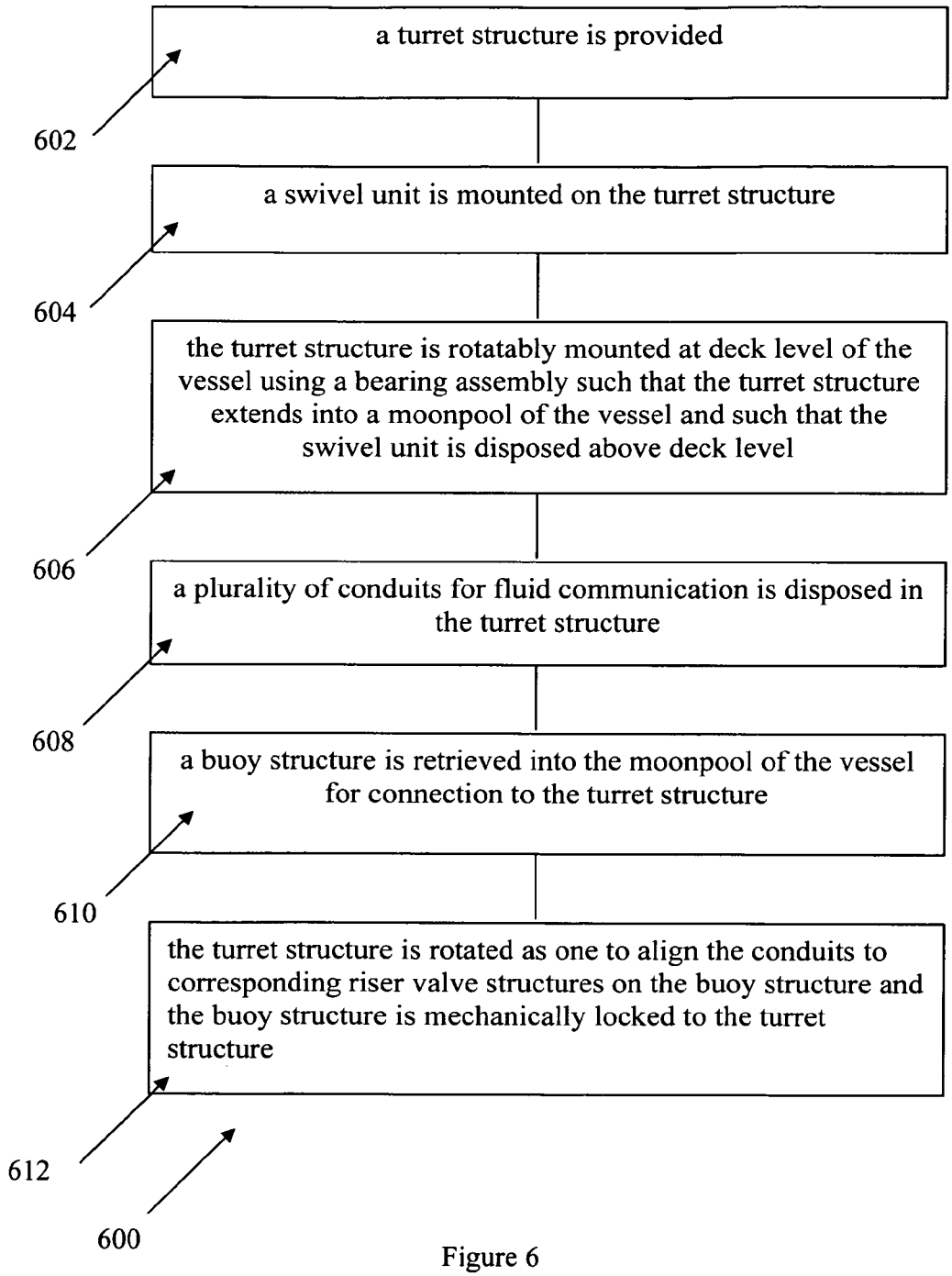
FIG. 6 is a schematic flowchart for illustrating a method of mooring a vessel.

FIG. 6 is a schematic flowchart 600 for illustrating a method of mooring a vessel. At step 602, a turret structure is provided. At step 604, a swivel unit is mounted on the turret structure. At step 606, the turret structure is rotatably mounted at deck level of the vessel using a bearing assembly such that the turret structure extends into a moonpool of the vessel and such that the swivel unit is disposed above deck level. At step 608, a plurality of conduits for fluid communication is disposed in the turret structure. At step 610, a buoy structure is retrieved into the moonpool of the vessel. At step 612, the turret structure is rotated as one to align the conduits to corresponding riser valve structures on the buoy structure and the buoy structure is mechanically locked to the turret structure.

In the described example embodiments, the shaft of the turret mooring system acts as one integrated structure and the fluid conduits of the shaft can advantageously be easily aligned relative to the buoy. There is no need for a separate rotatable turntable for aligning the fluid conduits to the risers of the buoy. The alignment of the fluid conduits is performed prior to mechanically locking the buoy in position. Thus, alignment can advantageously be completed in one operation i.e. there is no need for a prepositioning and a final alignment step. The shaft and the buoy can be maintained in position using the upper bearing assembly. Further, there is also no need for another structure, such as a cone structure in the prior art, to "support" the shaft. Also, without another structure such as the cone structure, the shaft and more particular the access platform of the example embodiments can be more accessible to service personnel. Furthermore, as the upper bearing assembly is on the deck level of the vessel, it is practically easy for maintenance to be carried out on the upper bearing assembly and for alignment operations. For example, since the upper bearing assembly comprises a plurality of axial bearing systems and radial bearing systems, each bearing system may be removed from operation, one at a time, for overhaul and/or inspection purposes. In addition, since the upper bearing assembly is disposed at deck level of the vessel, the diameter of the upper bearing assembly is approximately the same, and typically slightly larger than, the diameter of the moonpool. This can advantageously result in better performance, e.g. the upper bearing assembly can handle higher axial loading, as compared to bearing assemblies of those existing systems in which the diameter of the bearing is smaller than the diameter of the caisson or moonpool.

Furthermore, advantageously, since there is no need to pull the risers out from the buoy for fluid retrieval, there is a lower likelihood of damage to the risers and a lower danger of e.g. fire in the moonpool of the vessel. In addition, the riser connections are e.g. in the middle of the vessel. Since the riser connections are not at the bottom of the vessel, the buoy and the receptacle space of the shaft may be shaped such that alignment or retrieval of the buoy into the moonpool is relatively easier compared to the prior art. Further, there is also no need to lift the buoy to the top of the vessel for the fluid conduits to be connected to the risers. This may reduce the complexity and weight of the turret mooring system.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

What is claimed is:

1. A mooring system for a vessel, the system comprising:
a turret structure;
a swivel unit mounted on the turret structure;
a bearing assembly for rotatably mounting the turret structure at deck level of the vessel such that the turret structure extends into a moonpool of the vessel and such that the swivel unit is disposed above deck level;
a plurality of conduits for fluid communication disposed in the turret structure;
a buoy structure retrievable into the moonpool of the vessel and connectable to the turret structure;
a locking assembly for mechanically locking the buoy structure to the turret structure;
wherein the turret structure is rotatable to align the conduits to corresponding riser valve structures on the buoy structure prior to mechanically locking the buoy structure to the turret structure; and
wherein the turret structure further comprises a recovery winch unit and a guide arm for retrieving the buoy structure, the guide arm pivotably positioned on a wall of the moonpool in a manner such that a recovery rope is centralized inside the moonpool during retrieval of the buoy structure.

2. The system as claimed in claim 1, wherein the bearing assembly comprises a plurality of bearing systems, each bearing system comprising;
at least two bearing elements for balancing a roller shaft extending between the bearing elements;
a roller member rotatable about the roller shaft, wherein the bearing elements are configured in use to balance the roller shaft such that the roller member is maintained in a substantially transverse position with respect to the roller shaft.

3. The system as claimed in claim 2, wherein the bearing systems are disposed under a flange portion of the turret structure for supporting the turret structure.

4. The system as claimed in claim 1, wherein the bearing assembly is disposed at a circumference of the moonpool.

5. The system as claimed in claim 1, wherein the turret structure is rotatable without separate rotational movement of respective lower parts of the conduits.

6. The system as claimed in claim 1, wherein in a locked position, a top surface of the buoy structure is disposed substantially at a middle level of the moonpool.

7. The system as claimed in claim 1, wherein the swivel unit provides fluid connections between the plurality of conduits and one or more storage tanks on the vessel.

8. A mooring system for a vessel, the system comprising:
a turret structure including a turret flange and turret wall;
a moonpool in the vessel to receive and to support the turret structure, the moonpool including a moonpool upper flange, the turret structure extending into the moonpool and with the turret flange overlying the moonpool upper flange;
a self-aligning, upper bearing assembly mounted on the moonpool upper flange and at a deck level of the vessel to rotatably support the turret structure and to maintain a vertical position of the turret structure in the moonpool;
a plurality of conduits for fluid communication disposed in the turret structure;
a buoy structure retrievable into the moonpool of the vessel and connectable to the turret structure;
a locking assembly for mechanically locking the buoy structure to the turret structure;
wherein the turret structure is rotatable to align the conduits to corresponding riser valve structures on the buoy structure prior to mechanically locking the buoy structure to the turret structure;
wherein the self-aligning, upper bearing assembly comprises a plurality of axial bearing systems, each of which is adapted to maintain a vertical position of the turret structure with respect to the moonpool, and a plurality of radial bearing systems, each of which is adapted to absorb radial movement of the moonpool with respect to the turret structure, each such axial bearing system and each such radial bearing system being mounted on the moonpool upper flange and each comprising;
a roller shaft;
at least two bearing elements, the roller shaft in each bearing system extending between, and being supported by its at least two bearing elements; and
a roller member rotatable about the roller shaft of each bearing system,
wherein the bearing elements of each axial bearing system are configured to position the respective roller shaft of each axial bearing system in a horizontal position such that each axial bearing system roller member is maintained in a vertical position and is in contact with the turret flange, and further wherein the bearing elements of each radial bearing system are configured to position the respective roller shaft of each radial bearing system in a vertical position such that each radial bearing system roller member is maintained in a horizontal position and is in contact with the turret wall to maintain the turret structure in its vertical position in the moonpool.

9. The system as claimed in claim 8, wherein the self-aligning, upper bearing assembly is disposed at a circumference of the moonpool.

10. The system as claimed in claim 8, wherein the turret structure is rotatable without separate rotational movement of respective lower parts of the conduits.

11. The system as claimed in claim 8, wherein in a locked position, a top surface of the buoy structure is disposed substantially at a middle level of the moonpool.

12. The system as claimed in claim 8, wherein the turret structure further comprises a recovery winch unit and a guide arm for retrieving the buoy structure, the guide arm pivotably positioned on a wall of the moonpool in a manner such that a recovery rope is centralized inside the moonpool during retrieval of the buoy structure.

13. The system as claimed in claim 8 further including a swivel unit mounted on the turret structure and wherein the swivel unit provides fluid connections between the plurality of conduits and one or more storage receptacles.

* * * * *